United States Patent [19]

Rosendahl

[11] Patent Number: 5,029,511

[45] Date of Patent: Jul. 9, 1991

[54] EXCHANGEABLE PICKUPS FOR ELECTRIC GUITARS

[76] Inventor: Kevin Rosendahl, P.O. Box 15007, Des Moines, Iowa 50315

[21] Appl. No.: 495,595

[22] Filed: Mar. 19, 1990

[51] Int. Cl.[5] ..... G10H 3/00

[52] U.S. Cl. ..... 84/743; 84/723

[58] Field of Search ..... 84/723, 724, 726, 727, 84/728, 731, 732, 733, 734, 743, DIG. 24

[56] References Cited

U.S. PATENT DOCUMENTS

| | | | |
|---|---|---|---|
| 3,475,543 | 10/1969 | Burns | 84/743 |
| 4,133,243 | 1/1979 | DiMarzio | 84/743 |
| 4,254,683 | 3/1981 | Nulman | 84/743 |
| 4,425,831 | 1/1984 | Lipman | 84/743 |
| 4,433,603 | 2/1984 | Siminoff | 84/743 |
| 4,915,009 | 4/1990 | Kunstadt | 84/743 |
| 4,941,389 | 7/1990 | Wendler | 84/743 |

*Primary Examiner*—William M. Shoop, Jr.
*Assistant Examiner*—Helen Kim
*Attorney, Agent, or Firm*—Kent A. Herink; Brian J. Laurenzo

[57] ABSTRACT

A guitar pickup module for insertion in an electric guitar having a well for accommodating a pickup. The module includes a base plate which is mounted in the well and which includes a plurality of electrical contacts for attachment to the plurality of output wires of the guitar. The pickup includes a plurality of electrical contacts which are placed in electrical communication with the base plate contacts upon insertion of the pickup in the well on the base plate.

8 Claims, 3 Drawing Sheets

EXCHANGEABLE PICKUPS FOR ELECTRIC GUITARS

BACKGROUND OF THE INVENTION

The invention relates to pickups for electric guitars and, more specifically, to a pickup module for an electric guitar which permits the easy and convenient exchange of pickups.

A pickup consists essentially of an electromagnetic coil or a plurality of coils arranged beneath the strings of an electric guitar. Vibrations in the string of the guitar induce electrical signals in the coil of the pickup which are transmitted through output wires of the guitar to an amplifier or the like for reproduction of the vibrations of the strings. Conventional pickups are hard-wired into the body of the electric guitar. To service or replace the pickup requires the removal of the strings of the guitar and disconnection of the hard-wired electrical connection between the pickup and the output wires of the guitar. If the pickup is being replaced by one of an identical configuration, the new pickup is soldered to the output wires of the guitar and returned to position in the guitar body.

The present invention permits pickups of diverse manufacture to be easily and conveniently replaced or exchanged without requiring routing, chiseling, or other modification of the body of the guitar, of particular advantage if the guitar is valuable or unique.

SUMMARY OF THE INVENTION

A guitar pickup module for an electric guitar includes a base plate which is inserted into an existing well in the body of the guitar. A plurality of electrical contacts on the base plate are electrically connected to output wires of the guitar. A pickup including a plurality of electrical contacts corresponding to the electrical contacts of the base plate is adapted for releasable securement to the base plate wherein the electrical contacts of the pickup are in electrical communication with the contacts of the base plate. The pickup can be removed and replaced by releasing the tension on the strings of the guitar which are retensioned after replacement of the pickup. The base plate is height adjustable relative to the strings of the guitar to permit selective adjustment of selected pickups and to permit the accommodation of pickups of various heights.

DETAILED DESCRIPTION OF THE PREFERRED EMBODIMENTS

Figure 1:
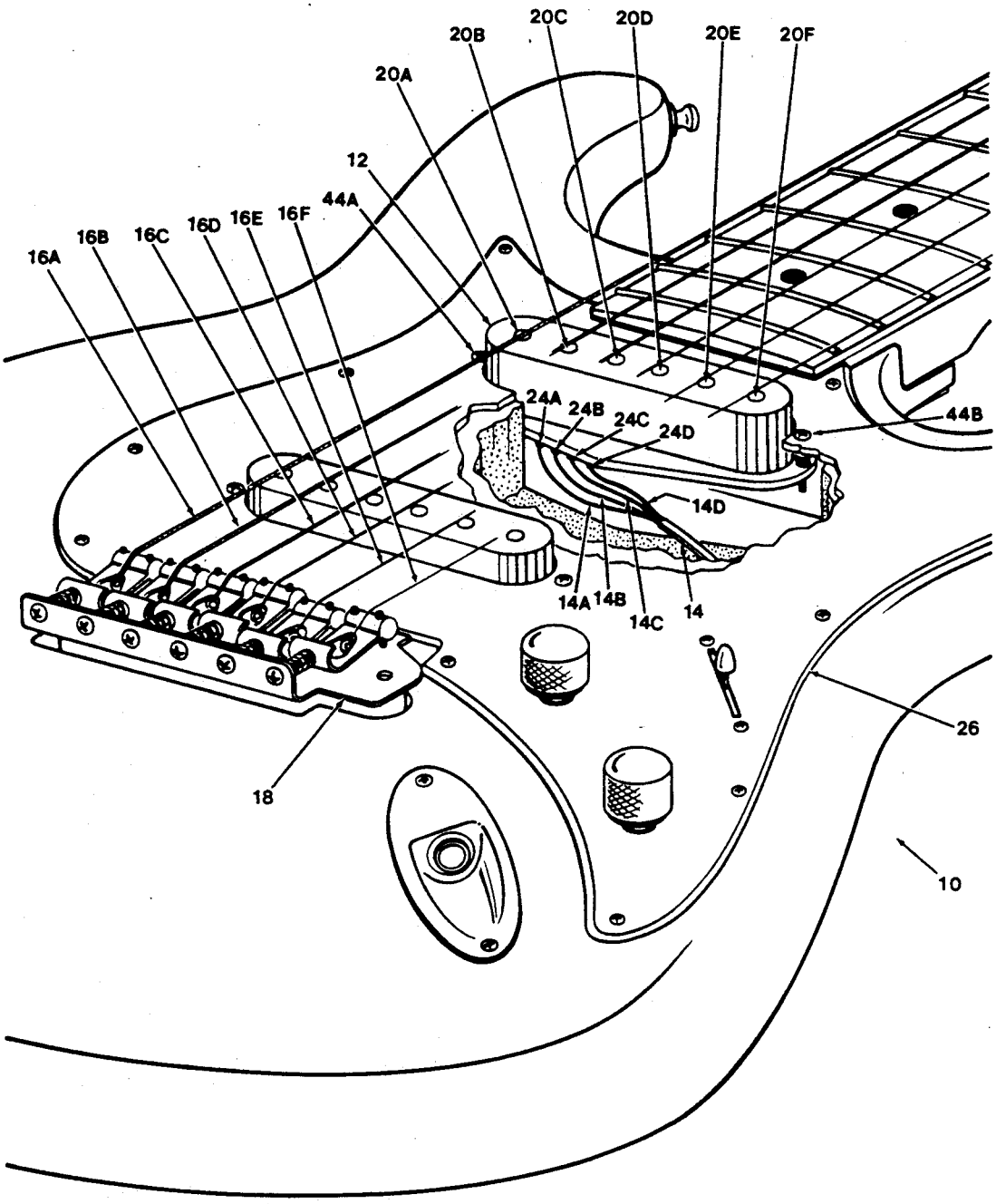
FIG. 1 is a perspective view of an electric guitar having a conventional pickup.

Illustrated in FIG. 1 generally at 10 is an electric guitar including a conventional pickup 12 which is hard-wired to the four output wires 14A–D of the guitar 10. The six strings 16A–F of the guitar 10 extend from a bridge 18 and a tension lever (not shown) near the base of the guitar 10 to tuning screws (also not shown) at the head of the guitar 10. While the preferred embodiment is being described with regard to a conventional six-string guitar, it is of equal advantage and applicability to bass guitars and other guitars or electronic musical instruments having any number of strings.

Each of the strings 16A–F passes over the conventional pickup 12 which typically includes six poles 20A–F each of which is spaced below a corresponding string 16A–F. As the guitar 10 is played, vibrations in the strings 16A–F induce electrical signals in the electromagnet coil of the poles 20A–F which are communicated to the output wires 14A–D which are combined in a cable 14. The signals are thereafter communicated to an amplifier system for amplified reproduction of the vibrations in the strings 16A–F of the guitar 10. The conventional pickup 12 may be secured to the body of the guitar 10 by screws 44A and 44B or by other suitable means. The output wires 14A–D are typically hard-wired by soldering to corresponding contacts 24A–24D of the conventional pickup 12. Replacement of the conventional pickup 12 requires that the strings be removed from the tensioning screws at the head of the guitar so that a guitar face plate 26 and the pickup 12 can be unscrewed from the guitar 10 and lifted out for access to the output wires 14A–D which are then disconnected from the pickup 12. If a pickup of a different configuration is to be substituted in the guitar 10, the body of the guitar 10 will have to be modified to create a well of the appropriate shape to accommodate the pickup.

Figure 2:
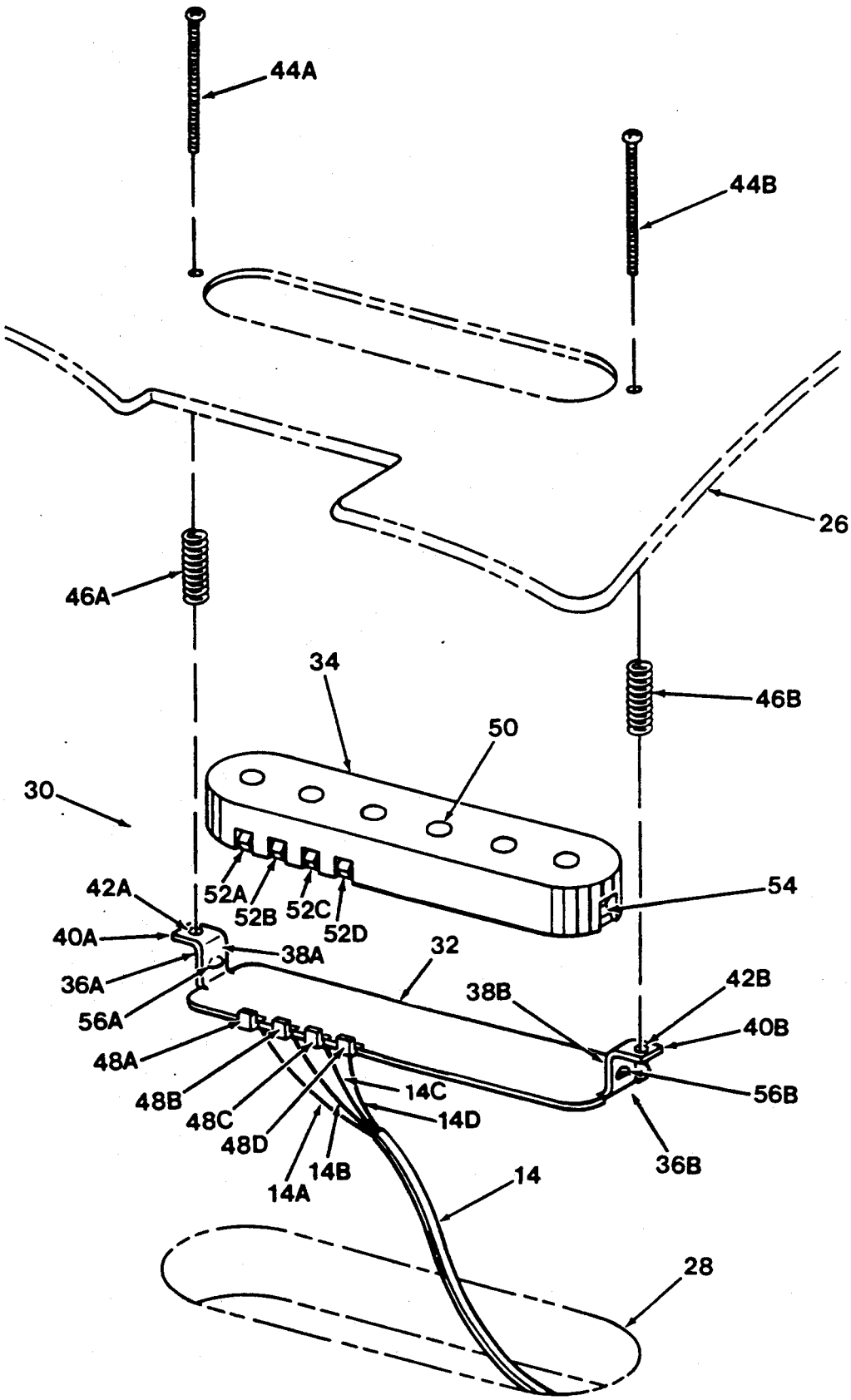
FIG. 2 is an exploded detail perspective view of a pickup module of the present invention in assembly relation with an electric guitar.

Referring to FIG. 2, there is illustrated a portion of the guitar face plate 26 and a pickup receiving well 28 in the body of the guitar. A guitar pickup module is illustrated generally at 30 and includes a base plate 32 and a pickup 34.

The base plate 32 is of a size and configuration to fit within the well 28 and includes mounting flanges 36A and 36B at either end thereof. The mounting flanges 36A–B have an upright portion 38A–B and an out turned horizontal portion 40A and 40B. Each horizontal section 40A and 40B includes a threaded throughbore 42A and 42B, respectively, which receive therein a bolt 44A and 44B used to attach the base plate 32 to the guitar face plate 26. One of a pair of springs 46A and 46B is received about a corresponding one of the bolts 44A and 44B between the guitar face plate 26 and the horizontal section 40A and 40B of the flanges 36A and 36B to maintain a preselected spaced-relation between the base plate 32 and the guitar face plate 26.

The base plate 32 includes four stand-off contacts 48A–D. Each of the output wires 14A–D is electrically connected to a corresponding one of the stand-off contacts 48A–D.

The pickup 34 includes six poles 50 in a similar manner as did the conventional pickup 12. The pickup 34 differs, however, in that it has four spring-biased contacts 52A–D corresponding in location to the four stand-off contacts 48A–D of the base plate 32. The contacts 52A–D are in electrical communication with the electromagnet coils of the pickup 34. At either end portion of the pickup 34 is a recess 54 which is received in a snap-fit beneath an inwardly projected lip 56 on the corresponding upright section 38 of the flanges 36. Accordingly, alignment of the pickup 34 on the base plate 32 followed by pressing of the two elements together will releasably secure the pickup 34 to the base plate 32 wherein the base plate contacts 48A–D are in electrical contact with the corresponding one of the pickup contacts 52A–D and the inwardly projected lips 56 releasably capture the pickup 34 at the recesses 54.

It can be seen, accordingly, that the pickup 34 can be easily and simply replaced merely by grasping of the pickup 34 which, in assembly would project above the guitar face plate 26, and substituting a new pickup in a snap-fit relation inside the base plate 32. Any variety of pickup can be accommodated provided only that it have the appropriate contacts 52A–D, recesses 54, and be of a size and configuration to fit through the face plate 26 and that a corresponding base plate 32 with contacts 48A–D is provided. Because only a very limited amount of clearance is required, the strings of the guitar do not have to be completely removed, but only released from tension during the replacement or exchange procedure.

Figure 3:
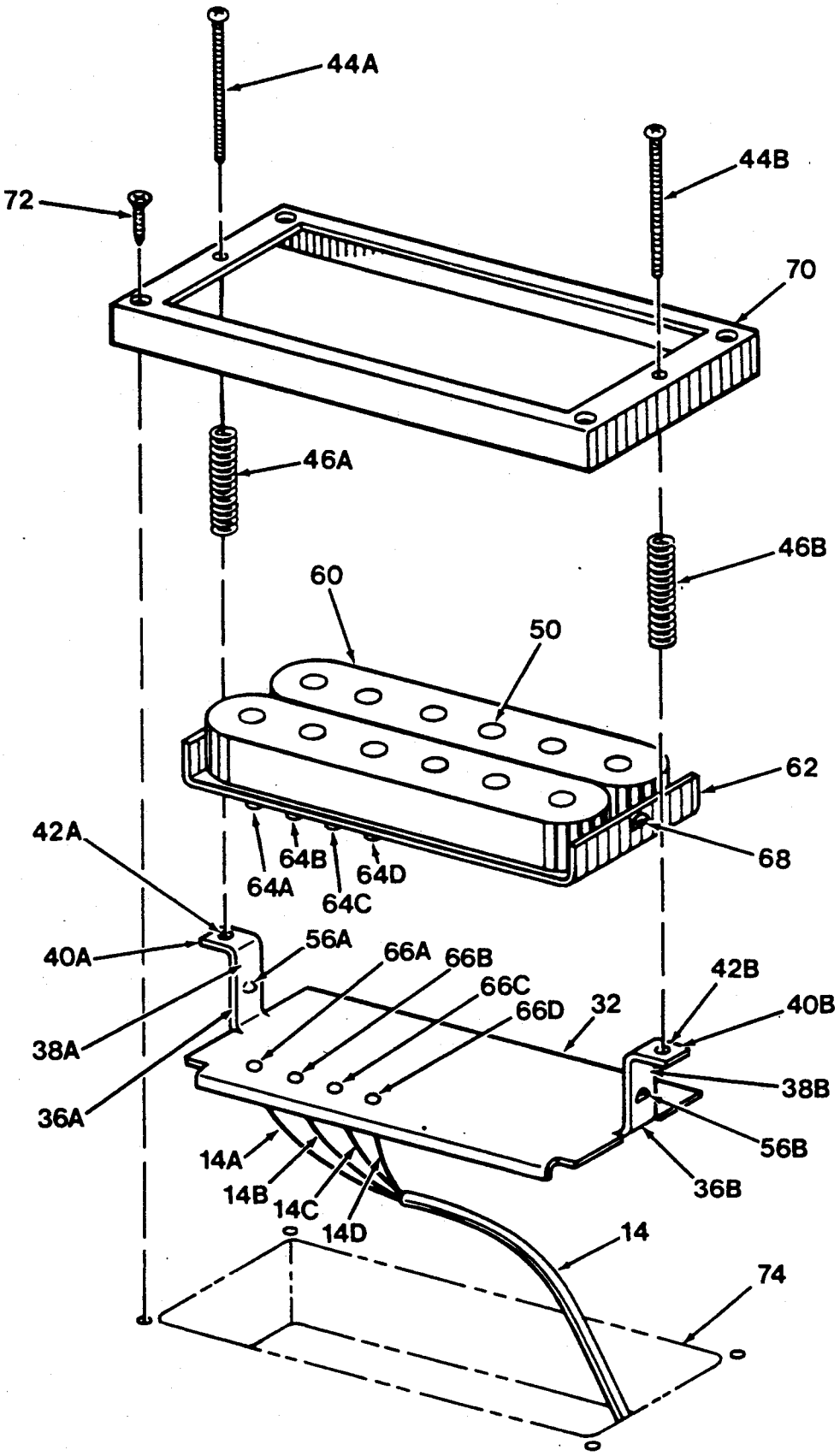
FIG. 3 is an exploded detail perspective view of a second preferred embodiment of the present invention shown in assembly relation with an electric guitar.

A second preferred embodiment is illustrated in FIG. 3 wherein parts corresponding to the first preferred embodiment are indicated using identical figure numbers. In this embodiment, a pickup 60 is attached to a mounting plate 62. Four pins 64A–D project laterally below the mounting plate 62 and are in electrical communication with the electromagnet coils of the pickup 60. Corresponding electrical contact receptacles 66A–D are provided in the base plate 32. Upon insertion of the mounting plate 62 atop the base plate 32, the pins 64A–D will be received in mating engagement inside a corresponding one of the electrical contact receptacles 64A–D. Moreover, a recess 68 at either end portion of the mounting plate 62 will releasably receive the corresponding inwardly projected lip 56 which will serve to releasably secure the mounting plate 62 to the base plate 32.

The base plate 32 is secured in a height adjustable relation to a mounting frame 70 by the bolts 44A–B and springs 46A–B. The completed assembly is secured to the body of the guitar by screws 72. As in the first embodiment, each of the four output wires 14A–D is electrically connected to a corresponding one of the electrical contact receptacles 66A–D of the base plate 32. The pickup 60 can be easily and conveniently replaced by grasping the pickup 60 to release the same from the base plate 32, whereupon a substitute mounting plate 62 and an associated pickup can be inserted in a snap-fit relation inside the guitar well 74.

Although the invention has been described with respect to two preferred embodiments thereof, it is to be understood that it is not to be so limited since changes and modifications, such as the number and design of the electrical contacts, the mounting method of the pickup, and the design of the pickup, can be made therein which are within the full intended scope of the invention as defined by the appended claims.

I claim:

1. A guitar pickup module for insertion in an electric guitar having a well for accommodating a pickup and a plurality of output wires, comprising:

(a) a base plate mounted in the wall and having a top surface facing the strings of the guitar;

(b) a plurality of electrically conductive contacts on said base plate each of which is in electrical communication with a corresponding one of said output wires;

(c) a pickup for releasable securement to said top surface of said base plate; and (d) a plurality of electrically conductive contacts on said pickup each of which is in electrical communication with the corresponding one of said base plate contacts.

2. The pick-up module as defined in claim 1, wherein said base plate is height adjustable relative to the strings of the guitar.

3. The pick-up module as defined in claim 1 wherein:

(a) said pickup contacts are laterally projected pins; and (b) said base plate contacts are receptacles for mating engagement with said pins.

4. The pickup module as defined in claim 1, wherein:

(a) said pickup contacts are spring-biased; and (b) said base plate contacts are laterally projected standoffs for mating engagement with said spring-biased contacts.

5. A method for exchanging pickups in an electric guitar having a well for accommodating a pickup and a plurality of output wires, comprising:

(a) mounting a base plate in the well, said base plate having a top surface facing the strings of the guitar;

(b) providing a plurality of electrically conductive contacts on said base plate each of which is in electrical communication with a corresponding one of said output wires;

(c) releasably securing to said top surface of said base plate a pickup having a plurality of electrically conductive contacts; and (d) bringing into electrical communication each of said pickup contacts with a corresponding one of said base plate contacts.

6. A method for exchanging pickups in an electric guitar as defined in claim 5 further comprising:

(a) releasing the tension on the strings of the guitar;

(b) removing the pickup from the base plate;

(c) securing to said base plate a second pickup having a plurality of electrically conductive contacts each one of which is in electrical communication with a corresponding one of the base plate contacts; and (d) returning the tension to the strings.

7. The method as defined in claim 6 wherein said base plate is height adjustable relative to the strings of the guitar.

8. The method as defined in claim 5, wherein said base plate is height adjustable relative to the strings of the guitar.

* * * * *